United States Patent [19]

Braun

[11] 3,991,284

[45] Nov. 9, 1976

[54] GRAMAPHONE PICKUP

[76] Inventor: Karl Braun, Kirchplatz 6, 8399 Rotthalmunster, Germany

[22] Filed: Jan. 23, 1974

[21] Appl. No.: 435,763

[30] Foreign Application Priority Data

Jan. 25, 1973 Germany ..... 2303455

[52] U.S. Cl. ..... 179/100.41 M; 179/100.41 K; 274/37

[51] Int. Cl.[2] ..... H04R 11/12; H04R 9/16

[58] Field of Search ..... 179/100.41 K, 100.41 M; 274/37, 38

[56] References Cited

UNITED STATES PATENTS

| | | | |
|---|---|---|---|
| 3,542,972 | 11/1970 | Braun | 179/100.41 K |
| 3,576,955 | 5/1971 | Obata | 179/100.41 M |
| 3,679,843 | 7/1972 | Cho | 179/100.41 K |
| 3,763,335 | 10/1973 | Morita | 179/100.41 M |

*Primary Examiner*—Alfred H. Eddleman
*Assistant Examiner*—Jay P. Lucas
*Attorney, Agent, or Firm*—Philip Furgang

[57] ABSTRACT

A gramophone or phono pickup comprising two magnetic systems, which are rotatable concentrically to a permanent magnetic armature, which is the transducer element and supports the needle arm. Two U-shaped iron cores with windings thereon are provided, which are arranged in view of the transducer element in such a manner that they can be turned round the transducer element concentrically. The unit of transducer element and needle arm is pivotally supported in the mass center of the entire transducer.

13 Claims, 9 Drawing Figures

GRAMAPHONE PICKUP

This invention refers to gramophone pickups for stereophonic and quadrophonic recording comprising two magnetic systems, which are concentrically rotatable around a permanent magnetic armature, whereby the armature forms the transducer element, which is attached to the needle arm.

A corresponding gramophone pickup has been proposed by the applicant's German Auslegeschrift 1,797,512. With said known electromagnetic gramophone pickup each of the two magnetic circuits of the pickup comprises a center web, which is located in the neutral zone of the magnetic circuit and which carries the winding. With a three-core magnetic circuit of this type the structure, and especially applying the winding is very difficult. Furthermore, the mechanic-magnetic efficiency of this arrangement is in need of improvement. Calculations have shown that the mass and, in combination therewith, the inertia of the sensing (scanning) element (which in the following is described as a "transducer") should be substantially decreased if high frequencies are to be sensed without distortion. For instance, with records for quadrophony an auxiliary carrier or about 30,000 Hz is recorded, which the transducer of the pickup is to follow.

A transducer generally consists of a sensing tip made of a jewel, the transducer element (which is preferably a small magnet), and a connecting member between the sensing tip and the transducer element. This connecting element, which is also called the needle support, usually is comprised of a thin-walled small tube of light metal.

It is an object of this invention to propose a pickup for stereophonic and quadrophonic recording with which the magnetic system has a structure as simple as possible and has a high mechanic-magnetic efficiency and with which the inertia of the entire transducer is as small as possible.

In accordance with this invention, it is proposed to arrange two U-shaped iron cores with windings in addition to the transducer element, which iron cores are pivotable concentrically around the transducer element. Such U-shaped magnetic circuits can be wound in a very simple manner and result in a far better mechanic-magnetic efficiency.

In further developing this invention, it is proposed to connect the transducer element and the needle arm rigidly to each other and to pivotally support the unit consisting of the transducer element and the needle arm forming the transducer within the mass center of the transducer. Preferably, the needle arm of the pickup is formed as a small tube supporting the needle, the surface of the tube being perforated or being of a grid structure. According to a specific embodiment of this invention, the needle supporting the tube has a rigid, stiffening outer skin, for instance from a layer made of eloxation. The needle support made in this manner allows to keep the inertia of the entire transducer very small because the needle support is the main portion of the inertia moment. By means of transverse bores or the like the mass of the needle supporting tube is decreased by about 30%, whereas the stiffness of the small tube made from light metal is increased considerably by means of the hard layer made of eloxation.

At one end of the perforated needle supporting tube the sensing (scanning) tip is provided at the opposite end of the transducer element. The transducer element is connected to the stationary part of the pickup by means of an attenuation ring, for instance a flexible ring of rubber. In order to give this attentuation ring, which preferably is made from butyl rubber, a sufficient flexibility it comprises a concentric cut-out or groove at the outer periphery. This attenuation ring forms the elastic suspension of the sensing (scanning) system.

For an optimal operation mode of the inventive pickup, it is essential that the elastically suspended system swings around the center point of the dynamic mass of the scanning system, which is the geometric center of the transducer element. This only can be obtained, especially with high frequencies, if the required point of rotation and the mass center of the entire transducer system are aligned, which fact is obtained by arranging a mass balance weight at the needle supporting tube, namely at the opposite end of the transducer. In so far a small cylindrical balance weight, preferably made of heavy metal is provided as close to the point of rotation as possible, the dimensions of which are chosen in such a manner that the mass of the needle supporting tube and the mass of the scanning tip are compensated. Without such a mass balance weight the scanning system would move along a different mass center, which would be provided in a distance in view of the required point of rotation within the needle supporting tube, so that an exact movement around the required point of rotation would be prevented and the transducer element, especially with high frequencies, would make wrong movements, which would result in distortions.

Because each part of the transducer must have a mass as small as possible in order to keep the inertia moment of the entire transducer as low as possible according to a further embodiment of the invention, it is proposed to use only those portions of the pole sheets which are adjacent the U-shaped arms of the magnetic circuit instead of circular pole sheets; those portions of the pole sheets, which are not active, can be omitted and therefore, an essential improvement is obtained for decreasing the inertia moment. Furthermore, the magnetic energy of the disc-like magnets is concentrated by means of the segment-shaped structure of the pole sheets within these segments so that a high magnetic efficiency will be obtained.

The above mentioned cut-out of the attenuation ring adds to a sufficiently high flexibility of the transducer system in view of the movements of the scanning tip so that the scanning system is able to follow all information of the record grooves without any distortions so that the record grooves are conserved and the scanning tip operates with a small support pressure.

The invention will be explained in connection with the drawings by means of one embodiment. The figures show:

Figure 2:
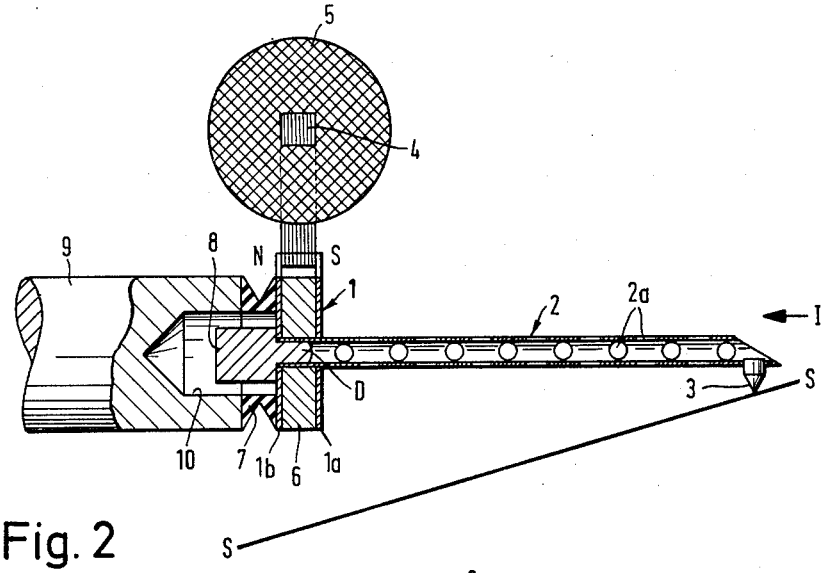
FIG. 2 is a longitudinal section through the pickup system taken along line A—A of FIG. 1.
Figure 3:
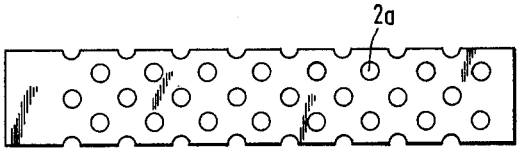
FIG. 3 is the development of the surface of the small needle supporting tube.
Figure 4:
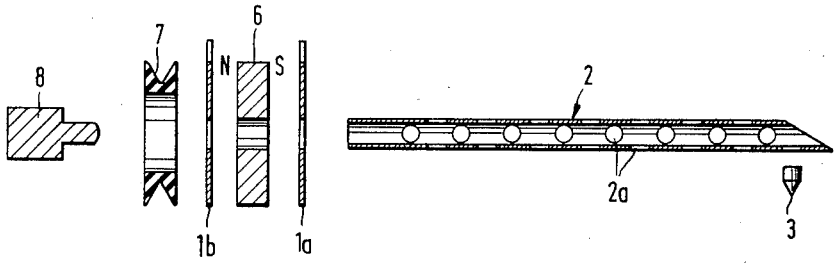
FIG. 4 is an exploded view of the structural elements of the transducer.
Figure 5:
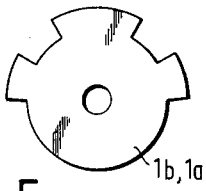
FIG. 5 is a front view of the pole sheets.
Figure 6:
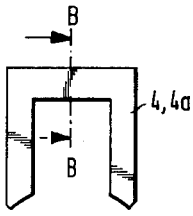
FIG. 6 is a front view of the core sheet packs.
Figure 7:
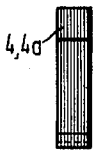
FIG. 7 is a cross-section through a core sheet pack according to FIG. 6 and taken along line B—B.

The transducer element 1 is connected to the needle support 2, which carries on its front end the sensing tip 3. The two U-shaped iron cores are indicated with 4 and 4*a*, the windings with 5 and 5*a*. Both coil systems are rotatable in the direction of the arrow E-E-E. 1*a* and 1*b* are the two coil sheets of the transducer element 1, which are provided with segments. As shown in FIG. 3, the needle support tube 2 is provided with transversal bores 2*a*. The sensing tip 3 is in engagement with the grooves of the record surface S—S, and from FIG. 2 can be seen that the entire pickup system operates inclined to the record surface in an angle of about 15° to 20°.

The laminated coil cores 4 and 4*a* carry the windings 5 and 5*a*. The ferrite magnet 6 is provided between the two core sheets 1*a* and 1*b*. The transducer element 1, which consists of the elements 1*a*, 1*b*, and 6 is attached to the butyl rubber disk 7 which has a groove-like recess at its periphery. The mass balance weight of heavy metal is shown at 8. 9 is a stationary portion provided within the pickup, which is also connected to the butyl ring. Cylindrical chamber 10, which is formed within the stationary portion 9 of the pickup allows a freedom of movement for the balance weight 8. This chamber 10 can be, at least partly, filled with a viscous attenuation mass, for instance a silicon paste so that the attenuation factor of the system can be influenced accordingly.

All parts of the transducer are bonded to each other.

Figure 8:
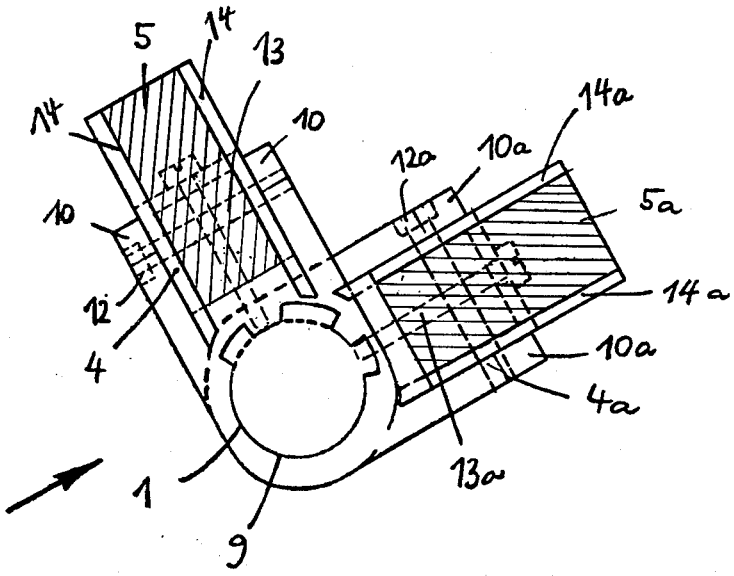
FIGS. 8 and 9 show schematically how the magnetic systems of FIGS. 1–7 are mounted with respect to the armature.
Figure 9:
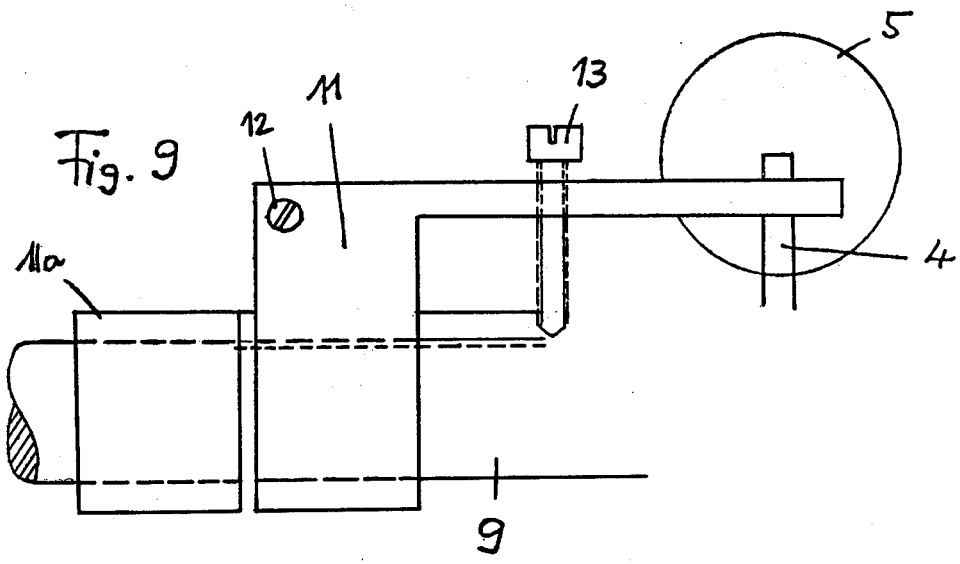

With reference to FIGS. 8 and 9 it will be seen that the iron cores 4, 4*a* with the windings 5, 5*a* are laterally supported by support arms 10, 10*a* which are in unity with a cylindrical sleeve 11, 11*a*, which sleeve surrounds the fixed cylindrical portion 9 of the pickup system. Both sleeves 11, 11*a* for the two magnetic systems are provided one behind the other in the longitudinal direction of stationary part 9 and are movable in the longitudinal direction of part 9 relative to part 9 and relative to each other. Besides of the difference in length of the supporting arms connected to the sleeve both sleeves 11, 11*a* with their arms 10, 10, 10*a* 10*a* are of identical structure. Each sleeve is slotted and a screw 12, 12*a* is provided through the portions separated by the slot by means of which screw the two halves of each sleeve can be pressed together more or less; in this manner both portions of the support system on the stationary part 9 can be fixed. Each of the two supporting members, furthermore is provided with an adjustment screw 13, 13*a*, by means of which the gap between the coil system 4, 5 and the transducer 1 can be varied by screwing the corresponding adjustment screw 13, 13*a* more or less against the stationary part 9 so that the corresponding arm of the support system which supports the coil system 4, 5 is deflected angularly to the longitudinal axis.

The entire support system is attached to the pickup arm or is connected with it in any manner. This connection has not been shown because it has nothing to do with the invention. Also the supporting system itself is not part of this invention, but is of usual and commercial type.

The arms 10, 10, 10*a*, 10*a* of the support means (made of metal) are bonded to the winding support 14, 14*a* of the winding 5, which winding support is made from insulating material. The connection lines for the windings are passed to the support through the winding support (not shown).

Figure 1:
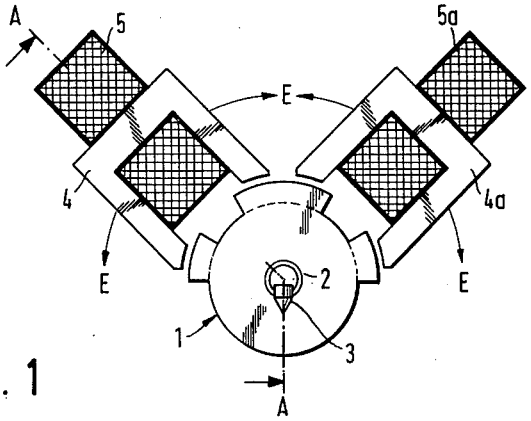
FIG. 1 is a schematic view of the pickup system according to this invention with a view from the front, whereby the coil system is shown in cross-section.

The operation mode of the inventive stereo pickup is the following:

With reference to FIGS. 1–7, if the transducer vibrates for instance by means of a drive in view of the modulation of a record groove in the plane of the section A—A of FIG. 1 no voltage is generated in the coil system, because in any moment of the movement of the tranducer similar magnetic conditions are obtained at the poles of the coil system, which are not able to generate an alternating flux within the U-shaped core. However, with the same assumed movement in coil system 4*a*, 5*a* a magnetic alternating flux is obtained, which induces within the winding 5*a* an alternating voltage. By means of the balance weight 8 it is guaranteed that the transducer only vibrates around point D, because this point D, because this point of rotation is identical with the dynamic centre of the entire transducer.

What is claimed is:

1. A gramophone pickup of the type used in connection with sterophonic or quadrophonic systems, comprising:
   a. an arm for supporting a needle;
   b. a permanent armature, comprising spaced, oppositely-poled pole pieces, affixed to said arm, each of said pole pieces having at least a portion thereof providing substantially parallel planar surfaces, said surfaces being substantially perpendicular to said arm, such that said pole pieces present a pair of facing planar surfaces to one another;
   c. two magnetic systems, each of said systems comprising a U-shaped iron core and windings, said windings being about said core;
   d. said systems being releasably secured for movement about said armature, said armature being aligned concentrically to said systems;
   e. said armature comprises the transducer element of said pickup; and
   f. each of said U-shaped iron cores being defined by opposed end surfaces, extending substantially parallel to the plane of said U-shape, each of said substantially planar surfaces of said cores extending substantially co-planar to said facing substantially planar surfaces of said pole pieces.

2. A pickup as recited in claim 1 further comprises:
means for pivotally supporting said arm and said transducer such that said pivotal movement is about the center of mass of said transducer and arm; said arm being rigidly affixed to said transducer.

3. A pickup as recited in claim 2 wherein
said arm comprises a tube having a plurality of apertures therein disposed in a grid-like pattern.

4. A pickup as recited in claim 3 wherein
said tube comprises a rigid outer skin of eloxation.

5. A pickup as recited in claim 4 further comprises:
a balance weight secured to one side of said armature; said arm being secured to an opposed side of said armature thereby making coincident the center of rotation of said systems and said center of mass.

6. A pickup as recited in claim 5 wherein said transducer comprises a disc-like magnet and substantially planar pole sheets of soft iron secured to opposed sides of said magnetic disc.

7. A pickup as recited in claim 2 further comprises:

a balance weight secured to one side of said armature, said arm being secured to an opposed side of said armature thereby making coincident the center of rotation of said systems and said center of mass.

8. A pickup as recited in claim 7 wherein said transducer comprises a disc-like magnet and substantially planar pole sheets of soft iron secured to opposed sides of said magnetic disc.

9. A pickup as recited in claim 8 further comprises:

relatively stationary mass means and a resilient attenuation ring, said ring comprises said pivotally supporting means and secures said armature to said stationary mass means, said ring having a circumferential recess in the outer wall to permit relative movement between said armature and mass.

10. A pickup as recited in claim 9 further comprises:

a viscous damping fluid, said mass having therewith a cavity, said fluid being within said cavity, said weight extending through said ring and into said cavity, said fluid surrounds said weight thereby damping said relative movement.

11. A pickup as recited in claim 7 further comprises:

relatively stationary mass means and a resilient attenuation ring, said ring comprises said pivotally supporting means and secures said armature to said stationary mass means, said ring having a circumferential recess in the outer wall to permit relative movement between said armature and mass.

12. A pickup as recited in claim 1 wherein said core comprises lamenated iron sheets.

13. A gramophone pickup of the type used in connection with stereophonic or quadraphonic systems, comprising:

a. an arm for supporting a needle;

b. a transducer element, comprising a laminent, permanent magnetic armature, comprising spaced, oppositely-poled pole pieces, rigidly secured to said arm, each of said pole pieces having at least a portion thereof, providing substantially parallel planar surfaces, said surfaces being substantially perpendicular to said arm, such that said pole pieces present a pair of facing substantially planar surfaces to one another;

c. two magnetic systems, each of said systems comprising a U-shaped iron core and windings thereon;

d. said magnetic systems being adjustably secured for being positioned about said armature, said armature being aligned concentrically to said systems; and e. each of said U-shaped iron cores having opposed substantially planar end surfaces, extending substantially parallel to one another and parallel to said plane defining said U-shape, each of said substantially planar surfaces of said iron cores extending substantially co-planar to said facing planar surfaces of said pole pieces.

* * * * *